US011393388B2

(12) United States Patent
Yue et al.

(10) Patent No.: US 11,393,388 B2
(45) Date of Patent: Jul. 19, 2022

(54) SHIFT REGISTER CIRCUIT, GATE DRIVING CIRCUIT AND METHOD OF DRIVING THE SAME, DISPLAY DEVICE PROVIDING IMPROVED FLEXIBILITY IN LIGHT EMITTING DURATION

(71) Applicant: BOE TECHNOLOGY GROUP CO., LTD., Beijing (CN)

(72) Inventors: Han Yue, Beijing (CN); Minghua Xuan, Beijing (CN); Can Zhang, Beijing (CN); Can Wang, Beijing (CN); Dongni Liu, Beijing (CN); Xiaochuan Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/825,046

(22) Filed: Mar. 20, 2020

(65) Prior Publication Data

US 2021/0065615 A1 Mar. 4, 2021

(30) Foreign Application Priority Data

Aug. 30, 2019 (CN) ..... 201910816790.3

(51) Int. Cl.
*G09G 3/32* (2016.01)

(52) U.S. Cl.
CPC ..... *G09G 3/32* (2013.01); *G09G 2310/0245* (2013.01); *G09G 2310/0286* (2013.01)

(58) Field of Classification Search
CPC ..... G09G 3/30; G09G 3/32; G09G 3/3208; G09G 3/3216; G09G 3/3225; G09G 3/36; G09G 3/3622; G09G 3/3625; G09G 2310/0286
USPC ..... 345/76–83, 87–104
See application file for complete search history.

(56) References Cited

U.S. PATENT DOCUMENTS

| | | | | |
|---|---|---|---|---|
| 10,714,002 | B2 * | 7/2020 | Lu | G09G 3/32 |
| 11,308,860 | B2 * | 4/2022 | Cong | G09G 3/32 |
| 2004/0066361 | A1 * | 4/2004 | Ishii | G09G 3/3677 345/87 |
| 2006/0170643 | A1 * | 8/2006 | Katayama | G09G 3/3688 345/100 |
| 2006/0227594 | A1 * | 10/2006 | Wang | G11C 11/413 365/154 |

(Continued)

*Primary Examiner* — Alexander Eisen
*Assistant Examiner* — Nelson Lam
(74) *Attorney, Agent, or Firm* — Nath, Goldberg & Meyer; Joshua B. Goldberg

(57) ABSTRACT

A shift register circuit and a method for driving the same, a gate driving circuit and a display device are provided. The shift register circuit includes an input terminal, a first control signal terminal, a second control signal terminal, and an output terminal, and further includes: an input module configured to receive an input signal input by the input terminal under the control of a first control signal input by the first control signal terminal and a second control signal input by the second control signal terminal; a storage module configured to store the input signal; a transmission module configured to transmit the input signal stored by the storage module to a preset node; and an output module configured to output a high level signal or a low level signal through the output terminal under the control of the input signal at the preset node.

11 Claims, 7 Drawing Sheets

(56) References Cited

U.S. PATENT DOCUMENTS

| | | | | |
|---|---|---|---|---|
| 2008/0062746 | A1* | 3/2008 | Loh | G11C 29/24 365/154 |
| 2009/0185654 | A1* | 7/2009 | Kang | G11C 19/28 377/78 |
| 2014/0055334 | A1* | 2/2014 | Qing | G11C 19/287 345/100 |
| 2014/0119490 | A1* | 5/2014 | Yang | G11C 19/28 377/64 |
| 2014/0191934 | A1* | 7/2014 | Koyama | G09G 3/3648 345/92 |
| 2016/0180800 | A1* | 6/2016 | Zheng | G09G 3/20 345/213 |
| 2017/0039973 | A1* | 2/2017 | Huang | G09G 3/3677 |
| 2017/0213500 | A1* | 7/2017 | Zhang | H02M 3/07 |
| 2019/0073948 | A1* | 3/2019 | Wang | G09G 3/3266 |
| 2021/0233483 | A1* | 7/2021 | Huang | G09G 3/36 |

* cited by examiner

SHIFT REGISTER CIRCUIT, GATE DRIVING CIRCUIT AND METHOD OF DRIVING THE SAME, DISPLAY DEVICE PROVIDING IMPROVED FLEXIBILITY IN LIGHT EMITTING DURATION

CROSS-REFERENCE TO RELATED APPLICATIONS

The present application claims the priority of Chinese Patent Application No. 201910816790.3, filed on Aug. 30, 2019, the contents of which are incorporated herein in their entirety by reference.

TECHNICAL FIELD

The present disclosure relates to the field of display technology, and in particular, to a shift register circuit, a method for driving the shift register circuit, a gate driving circuit, and a display device.

BACKGROUND

During self-luminous display control, gray scale is controlled by both current and time. The control capability of the current is limited, so that it is difficult to give consideration to both high brightness and high contrast ratio, particularly for an inorganic light emitting diode. The photoelectric characteristics of the inorganic light emitting diode would drift along with the current, and thus the control needs to be performed by the time, the control performed by the time is generally carried out by a shift register circuit, and the pulse required by the light emitting duration is transferred row by row, so that the range of the pulse width which can be output by the shift register circuit is the adjustable range of the light emitting duration. A display device usually has a plurality of pixel circuits, the light emitting signal in each pixel circuit may be transferred row by row through the shift register circuit, and the duration of the active level of the light emitting signal represents the light emitting duration.

SUMMARY

An embodiment of the present disclosure provides a shift register circuit, which includes an input terminal, a first control signal terminal, a second control signal terminal, and an output terminal, and further includes: an input module, coupled to the input terminal, the first control signal terminal and the second control signal terminal, and configured to receive an input signal input by the input terminal under the control of a first control signal input by the first control signal terminal and a second control signal input by the second control signal terminal; a storage module, coupled to the input module and configured to store the input signal received by the input module; a transmission module, coupled to the storage module, the first control signal terminal and the second control signal terminal nd configured to transmit the input signal stored by the storage module to a preset node under the control of the first control signal and the second control signal; and an output module, coupled to the preset node, the output terminal, a high level bias voltage line and a low level bias voltage line and configured to output a high level signal or a low level signal through the output terminal under the control of the input signal at the preset node.

In some implementations, the first control signal and the second control signal are complementary.

In some implementations, the storage module includes a first storage sub-module and a second storage sub-module, and the input module includes: a first thin film transistor, which has a first electrode coupled to the input terminal, a second electrode coupled to the first storage sub-module to form a first node, and a gate electrode coupled to the first control signal terminal; and a third thin film transistor, which has a first electrode coupled to the input terminal, a second electrode coupled to the second storage sub-module to form a second node, and a gate electrode coupled to the second control signal terminal.

In some implementations, the transmission module includes: a second thin film transistor, which has a first electrode coupled to the first node, a second electrode coupled to the preset node, and a gate electrode coupled to the second control signal terminal; and a fourth thin film transistor, which has a first electrode coupled to the second node, a second electrode coupled to the preset node, and a gate electrode coupled to the first control signal terminal.

In some implementations, the first thin film transistor, the second thin film transistor, the third thin film transistor, and the fourth thin film transistor are all N-type thin film transistors.

In some implementations, the output module includes: an inverter sub-module, coupled to the preset node and configured to output a signal which is inverted to the input signal at the preset node; a fifth thin film transistor, which has a first electrode coupled to the high level bias voltage line, a second electrode coupled to the output terminal, and a gate electrode coupled to the preset node; and a sixth thin film transistor, which has a first electrode coupled to the output terminal, a second electrode coupled to the low level bias voltage line, and a gate electrode coupled to the preset node through the inverter sub-module.

In some implementations, the fifth thin film transistor and the sixth thin film transistor are both N-type thin film transistors.

In some implementations, the inverter sub-module includes: a seventh thin film transistor, which has a first electrode coupled to a first high level terminal, a second electrode coupled to the gate electrode of the sixth thin film transistor, and a gate electrode coupled to the preset node; and an eighth thin film transistor, which has a first electrode coupled to the gate electrode of the sixth thin film transistor, a second electrode coupled to a first low level terminal, and a gate electrode coupled to the preset node.

In some implementations, the seventh thin film transistor is a P-type thin film transistor and the eighth thin film transistor is an N-type thin film transistor.

In some implementations, the first storage sub-module includes a first capacitor, which has one terminal coupled to the first node, and the other terminal coupled to a first common terminal; the second storage sub-module includes a second capacitor, which has one terminal coupled to the second node, and the other terminal coupled to a second common terminal.

In some implementations, the first storage module includes a ninth thin film transistor, a tenth thin film transistor, an eleventh thin film transistor, and a twelfth thin film transistor, a first electrode of the ninth thin film transistor and a first electrode of the eleventh thin film transistor are both coupled to a second high voltage terminal, a second electrode of the ninth thin film transistor is coupled to a first electrode of the tenth thin film transistor, a gate electrode of the eleventh thin film transistor and a gate electrode of the twelfth thin film transistor, a gate electrode of the ninth thin film transistor and a gate electrode of the tenth thin film transistor are both coupled to the first node, a second electrode of the tenth thin film transistor and a second electrode of the twelfth thin film transistor are both coupled to a second low voltage terminal, a second electrode of the eleventh thin film transistor is coupled to the first node and a first electrode of the twelfth thin film transistor; the second storage sub-module includes a thirteenth thin film transistor, a fourteenth thin film transistor, a fifteenth thin film transistor, and a sixteenth thin film transistor, a first electrode of the thirteenth thin film transistor and a first electrode of the fifteenth thin film transistor are both coupled to a third high voltage terminal, a second electrode of the thirteenth thin film transistor is coupled to the first electrode of the fourteenth thin film transistor, the gate electrode of the fifteenth thin film transistor and the gate electrode of the sixteenth thin film transistor, a gate electrode of the thirteenth thin film transistor and a gate electrode of the fourteenth thin film transistor are both coupled to the first node, a second electrode of the fourteenth thin film transistor and a second electrode of the sixteenth thin film transistor are both coupled to a third low voltage terminal, a second electrode of the fifteenth thin film transistor is coupled to the second node and a first electrode of the sixteenth thin film transistor.

In some implementations, the ninth, eleventh, thirteenth and fifteenth thin film transistors are all P-type thin film transistors, and the tenth, twelfth, fourteenth and sixteenth thin film transistors are all N-type thin film transistors.

An embodiment of the present disclosure further provides a method for driving the shift register circuit provided by the embodiment of the present disclosure, the method including: in a first stage, applying the input signal to the input terminal, and applying the first level signal and the second level signal to the first control signal terminal and the second control signal terminal respectively, so that the input module receives the input signal and stores the input signal in the storage module; and in a second stage, applying the second level signal and the first level signal to the first control signal terminal and the second control signal terminal respectively, so that the input signal stored by the storage module in the first stage is transmitted to the preset node through the transmission module and is output from the output terminal through the output module.

An embodiment of the present disclosure further provides a gate driving circuit, which includes multiple stages of shift register units, each stage of shift register unit includes the shift register circuit provided in the embodiment of the present disclosure, and an output terminal of the shift register circuit in a current stage of shift register unit is an input terminal of the shift register circuit in a next stage of shift register unit.

An embodiment of the present disclosure further provides a display device, which includes the gate driving circuit provided in the embodiment of the present disclosure.

DESCRIPTION OF EMBODIMENTS

Features and advantages of solutions of the present disclosure would become apparent by reference to following descriptions. Embodiments of the present disclosure would be described in detail below, and examples of the embodiments are illustrated in accompanying drawings. Like reference signs refer to the same or similar elements or elements having the same or similar functions throughout the drawings. The embodiments described below with reference to the accompanying drawings are illustrative for explaining the present disclosure, and should not be construed as limiting the present disclosure.

Figure 1:
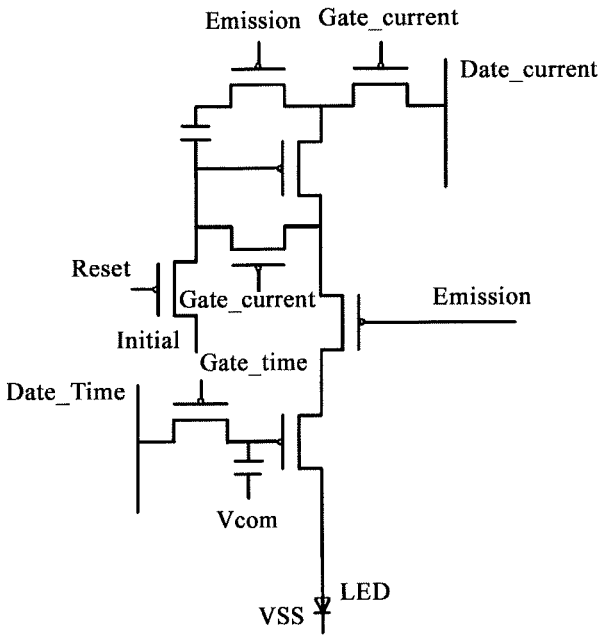
FIG. 1 (Prior Art)
FIG. 1 is a schematic diagram of a structure of a pixel circuit.
Figure 2:
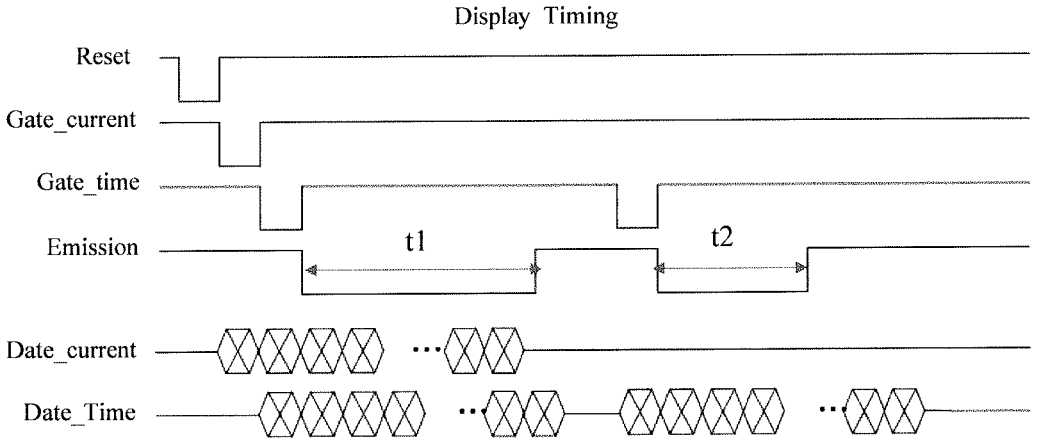
FIG. 2 (Prior Art)
FIG. 2 is a timing diagram of signals in the pixel circuit shown in FIG. 1.

FIG. 1 is a circuit diagram of a pixel circuit, and FIG. 2 is a timing diagram of signals in the pixel circuit shown in FIG. 1. An emission signal Emission (i.e., a light emitting signal) in the pixel circuit may be transferred row by row through a shift register circuit, and a duration of an active level (e.g., a low level) of the emission signal Emission determines a light emitting duration (e.g., t1 and t2) of a self-luminous element LED. However, the range of the pulse width that can be output by a shift register circuit in the related art is limited, and thus the adjustable range of the light emitting duration of the self-luminous element LED is suppressed, which becomes a barrier to the flexibility of controlling the light emitting duration, and particularly cannot give consideration to both long light emitting duration and short light emitting duration.

Figure 3:
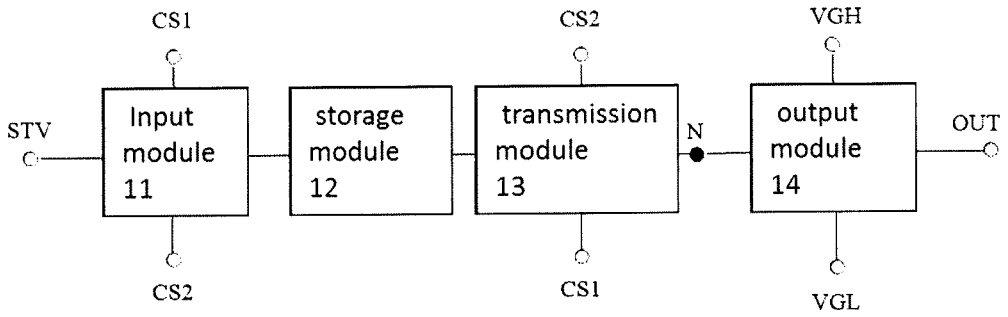
FIG. 3 is a module diagram of a shift register circuit according to an embodiment of the present disclosure.

FIG. 3 is a module diagram of a shift register circuit according to an embodiment of the present disclosure.

As shown in FIG. 3, the shift register circuit 10 includes an input terminal STV, a first control signal terminal CS1, a second control signal terminal CS2, an output terminal OUT, an input module 11, a storage module 12, a transmission module 13, and an output module 14.

The input module 11 is coupled to the input terminal STV, the first control signal terminal CS1 and the second control signal terminal CS2 respectively, and is configured to receive an input signal input from the input terminal STV under the control of a first control signal input from the first control signal terminal CS1 and a second control signal input from the second control signal terminal CS2. The storage module 12 is coupled to the input module 11 and configured to store the input signal received by the input module 11. The transmission module 13 is coupled to the storage module 12, the first control signal terminal CS1 and the second control signal terminal CS2 respectively, and configured to transmit the input signal stored by the storage module 12 to a preset node N under the control of the first control signal and the second control signal. The output module 14 is coupled to the preset node N, the output terminal OUT, a high level bias voltage line VGH, and a low level bias voltage line VGL respectively, and configured to output a high level or a low level through the output terminal OUT under the control of the input signal at the preset node N.

In some implementations, the first control signal and the second control signal may be complementary.

It should be noted that, the input signal, the first control signal, and the second control signal in the embodiment may each include a high level signal and a low level signal. The high level signal and the low level signal are relative to each other, the high level signal represents a higher voltage, for example, 10V, 15V, and multiple high level signals may be the same or different. Similarly, the low level signal indicates a lower voltage, such as −5V, −10V, and multiple low level signals may be the same or different. For example, when the first control signal is a high level signal, the second control signal may be a low level signal, or when the second control signal is a high level signal, the first control signal may be a low level signal, so that the first control signal and the second control signal are complementary.

In practical applications, for example, in a first stage, an input signal is input to the input terminal STV, the first control signal is applied to the first control signal terminal CS1, the second control signal is applied to the second control signal terminal CS2, and the input module 11 receives the input signal input by the input terminal STV under the control of the first control signal and the second control signal, and transmits the received input signal to the storage module 12 to store the input signal; in a second stage, the first control signal and the second control signal are applied to the first control signal terminal CS1 and the second control signal terminal CS2, so that the transmission module 13 transmits the input signal stored in the storage module 12 to the preset node N under the control of the first control signal and the second control signal, and the output module 14 outputs a high level signal or a low level signal through the output terminal OUT under the control of the input signal at the preset node N.

The pulse width of one high level signal or low level signal of the first control signal terminal CS1 and the second control signal terminal CS2 is defined as a unit pulse width, which is represented by 1H. The effective pulse width of the input signal input through the input terminal STV may be adjusted and controlled arbitrarily, and thus an effective pulse with any integral multiple of unit pulse widths is generated at the output terminal OUT, and a range of the pulse width is adjustable arbitrarily. In the self-luminous display circuit, the effective pulse width of the output terminal OUT of the shift register circuit 10 is the light emitting duration, so that the light emitting duration can be controlled more flexibly by controlling the light emitting duration through the shift register circuit 10 in the embodiment.

That is to say, the shift register circuit of the embodiment of the present disclosure can generate the pulse of any integer multiple of the unit pulse widths, and then control the light emitting duration by transferring the pulse of any integer multiple of the unit pulse widths, thereby improving flexibility of controlling the light emitting duration.

Figure 4:
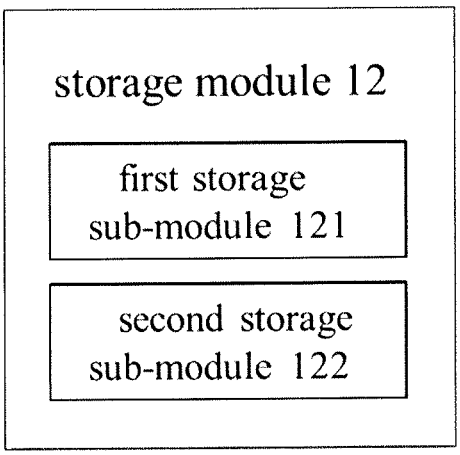
FIG. 4 is a module diagram of a storage module in a shift register circuit according to an embodiment of the present disclosure.
Figure 5:
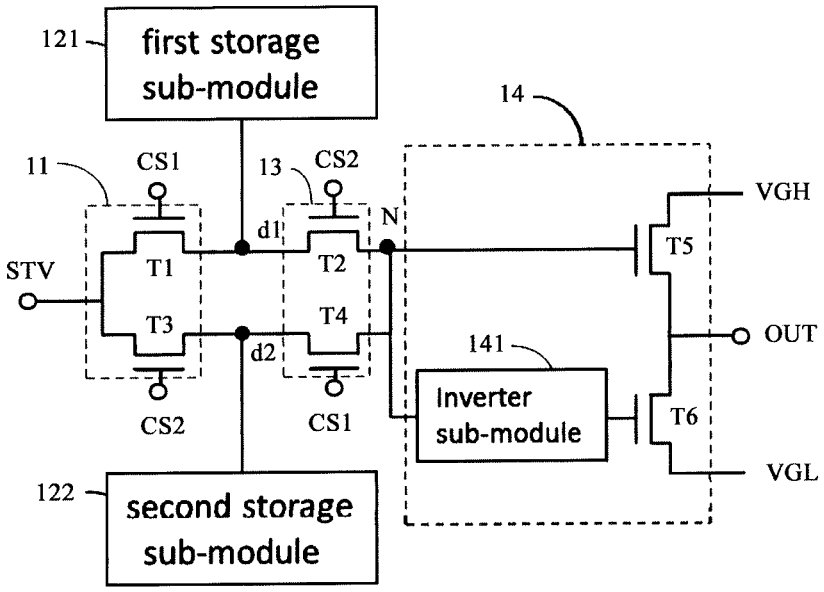
FIG. 5 is a diagram illustrating a shift register circuit according to an embodiment of the present disclosure.

In some implementations, as shown in FIG. 4, the storage module 12 may include a first storage sub-module 121 and a second storage sub-module 122, and as shown in FIG. 5, the input module 11 may include a first thin film transistor T1 and a third thin film transistor T3.

A first electrode of the first thin film transistor T1 is coupled to the input terminal STV, a second electrode of the first thin film transistor T1 is coupled to the first storage sub-module 121 to form a first node d1, and a gate electrode of the first thin film transistor T1 is coupled to the first control signal terminal CS1; a first electrode of the third thin film transistor T3 is coupled to the input terminal STV, a second electrode of the third thin film transistor T3 is coupled to the second storage sub-module 122 to form a second node d2, and a gate electrode of the third thin film transistor T3 is coupled to the second control signal terminal CS2.

Further, referring to FIG. 5, the transmission module 13 may include a second thin film transistor T2 and a fourth thin film transistor T4. A first electrode of the second thin film transistor T2 is coupled to the first node d1, a second electrode of the second thin film transistor T2 is coupled to the preset node N, and a gate electrode of the second thin film transistor T2 is coupled to the second control signal terminal CS2; a first electrode of the fourth thin film transistor T4 is coupled to the second node d2, a second electrode of the fourth thin film transistor T4 is coupled to the preset node N, and a gate electrode of the fourth thin film transistor T4 is coupled to the first control signal terminal CS1.

In the embodiment, when the first thin film transistor T1 and the third thin film transistor T3 are respectively applied with the first control signal and the second control signal which are complementary, one of the first thin film transistor T1 and the third thin film transistor T3 is turned on, and the other of the first thin film transistor T1 and the third thin film transistor T3 is turned off, so that the input signal is transmitted to the storage module 12 through the turned on thin film transistor; when the second thin film transistor T2 and the fourth thin film transistor T4 are respectively applied with the second control signal and the first control signal which are complementary, one of them is turned on, and the other of them is turned off, so that the input signal stored in the storage module 12 is transmitted to the preset node N through the turned on thin film transistor. The first to fourth thin film transistors T1 to T4 may be all N-type thin film transistors, i.e., turned on when the gate electrode thereof is at a high level.

Figure 6:
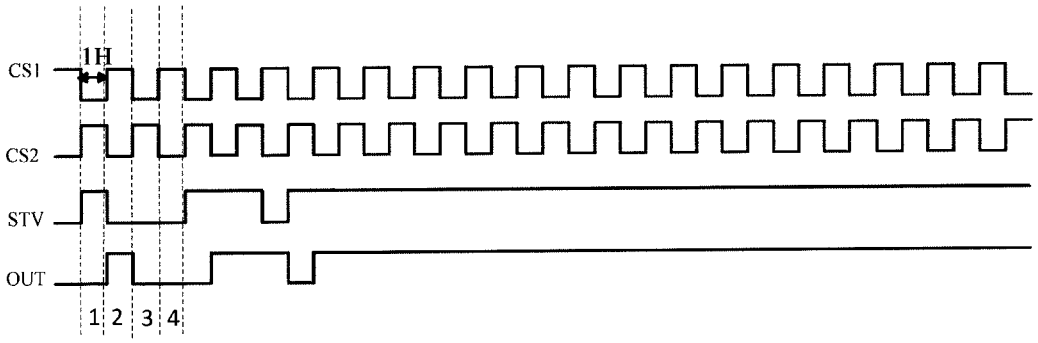
FIG. 6 is a timing diagram of signals in a shift register circuit according to an embodiment of the present disclosure.

For example, the input signal of the input terminal STV is a high level signal. Referring to FIGS. 5 and 6, for example, in the first stage, the first control signal and the second control signal are respectively applied to the gate electrodes of the first thin film transistor T1 and the third thin film transistor T3, and the first control signal and the second control signal may be a low level signal and a high level signal, respectively, so that the first thin film transistor T1 is turned off under the control of the first control signal, the third thin film transistor T3 is turned on under the control of the second control signal, and the input signal (e.g., a high level signal) is written into the second storage sub-module 122 through the third thin film transistor T3 and is stored; in the second stage, the second control signal and the first control signal are respectively applied to the gate electrodes of the second thin film transistor T2 and the fourth thin film transistor T4, and the first control signal may be a high level signal, and the second control signal may be a low level signal, so that the second thin film transistor T2 is turned off under the control of the second control signal, the fourth thin film transistor T4 is turned on under the control of the first control signal, and then the input signal in the second storage sub-module 122 is transmitted to the preset node N through the fourth thin film transistor T4, and then the output module 14 outputs a high level signal through the output terminal OUT under the control of the input signal (e.g., a high level signal) at the preset node N, and the first stage and the second stage are cyclically performed, so that the output terminal OUT generates the pulse with integral multiple of unit pulse widths.

Therefore, the transmission of the input signal is realized through the first thin film transistor to the fourth thin film transistor, and the output terminal outputs the pulse with adjustable level, so that the flexibility of controlling the light emitting duration is improved.

In some implementations, referring to FIG. 5, the output module 14 may include an inverter sub-module 141, a fifth thin film transistor T5, and a sixth thin film transistor T6.

A first electrode of the fifth thin film transistor T5 is coupled to the high level bias voltage line VGH, a second electrode of the fifth thin film transistor T5 is coupled to the output terminal OUT, and a gate electrode of the fifth thin film transistor T5 is coupled to the preset node N; a first electrode of the sixth thin film transistor T6 is coupled to the output terminal OUT, a second electrode of the sixth thin film transistor T6 is coupled to the low level bias voltage line VGL, and a gate electrode of the sixth thin film transistor T6 is coupled to the preset node N through the inverter sub-module 141.

Figure 7:
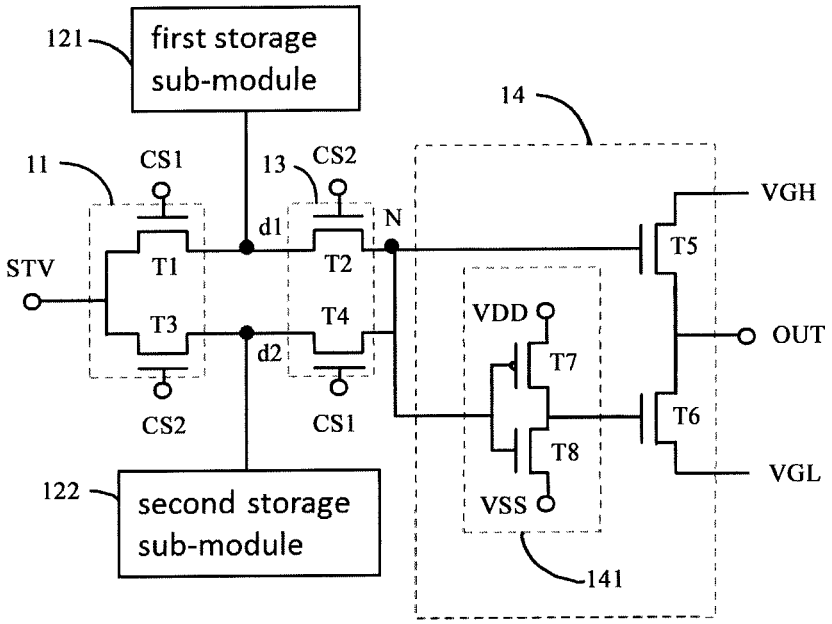
FIG. 7 is a diagram illustrating a shift register according to an embodiment of the present disclosure.

Further, as shown in FIG. 7, the inverter sub-module 141 may include a seventh thin film transistor T7 and an eighth thin film transistor T8.

A first electrode of the seventh thin film transistor T7 is coupled to a first high level terminal VDD, a second electrode of the seventh thin film transistor T7 is coupled to the gate electrode of the sixth thin film transistor T6, and a gate electrode of the seventh thin film transistor T7 is coupled to the preset node N; a first electrode of the eighth thin film transistor T8 is coupled to the gate electrode of the sixth thin film transistor T6, a second electrode of the eighth thin film transistor T8 is coupled to a first low level terminal VSS, and a gate electrode of the eighth thin film transistor T8 is coupled to the preset node N. The seventh thin film transistor T7 may be a P-type thin film transistor, i.e., turned on when the gate electrode thereof is at a low level, and the eighth thin film transistor T8 may be an N-type thin film transistor, i.e., turned on when the gate electrode is at a high level.

In the embodiment, due to the existence of the inverter sub-module 141, when the fifth thin film transistor T5 and the sixth thin film transistor T6 are subjected to the input signal at the preset node N, one of them is turned on, and the other of them is turned off, so that the input signal is transmitted to the output terminal OUT through the turned on thin film transistor. The fifth thin film transistor T5 and the sixth thin film transistor T6 may be both N-type thin film transistors, i.e., turned on when the gate electrodes thereof are at a high level.

Specifically, if the input signal at the preset node N is a high level signal, the high level signal is input into the inverter sub-module 141 and then converted into a low level signal, so that the sixth thin film transistor T6 is turned off under the control of the low level signal, meanwhile, the fifth thin film transistor T5 is turned on under the control of the high level signal, and then the input signal at the preset node N is transmitted to the output terminal OUT through the fifth thin film transistor T5, and the output terminal OUT outputs the high level signal; if the input signal is a low level signal, the fifth thin film transistor T5 is turned off under the control of the low level signal, and meanwhile, the low level signal is converted into a high level signal after passing through the inverter sub-module 141, so that the sixth thin film transistor T6 is turned on under the control of the high level signal, and then the input signal at the preset node N is transmitted to the output terminal OUT through the sixth thin film transistor T6, and the output terminal OUT outputs the low level signal.

It should be understood that, for the inverter sub-module 141, when the input signal at the preset node N is a high level signal, the eighth thin film transistor T8 is turned on, the seventh thin film transistor T7 is turned off, the output of the inverter sub-module 141 is pulled down to be a low level signal, and the sixth thin film transistor T6 is turned off; when the input signal at the preset node N is a low level signal, the eighth thin film transistor T8 is turned off, the seventh thin film transistor T7 is turned on, the output of the inverter sub-module 141 is pulled up to be a high level signal, and the sixth thin film transistor T6 is turned on.

Figure 8:
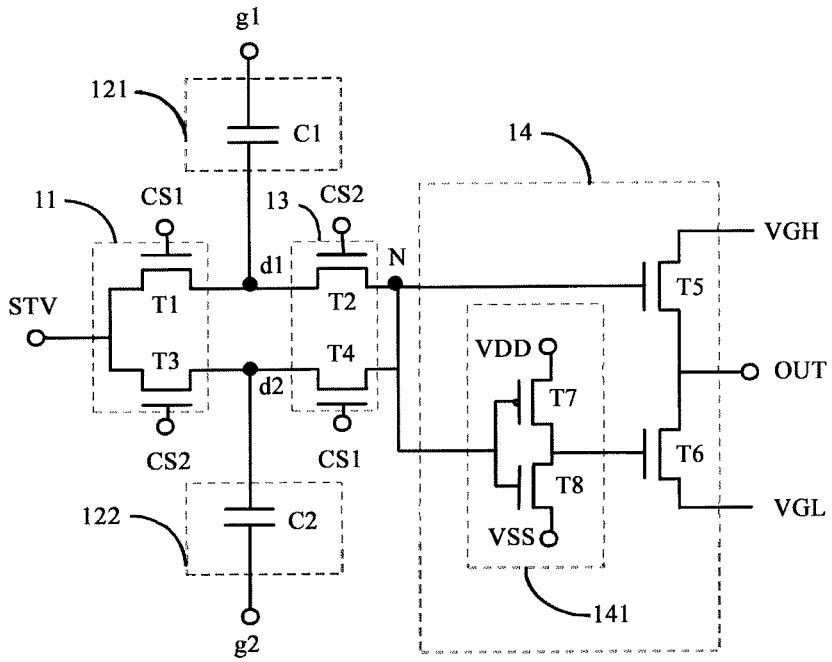
FIG. 8 is a diagram illustrating a shift register circuit according to an embodiment of the present disclosure.

In some implementations, as shown in FIG. 8, the first storage sub-module 121 may include a first capacitor C1, a terminal of the first capacitor C1 is coupled to the first node d1, and another terminal of the first capacitor C1 is coupled to a first common terminal g1; the second storage sub-module 122 may include a second capacitor C2, a terminal of the second capacitor C2 is coupled to the second node d2, and another terminal of the second capacitor C2 is coupled to the second common terminal g2.

Specifically, the input signal is stored through charging and discharging of the first capacitor C1 and the second capacitor C2, and when the input signal is a high level signal, the first capacitor C1 or the second capacitor C2 is charged, that is, the high level signal is stored; when the input signal is a low level signal, the first capacitor C1 or the second capacitor C2 is discharged, and the low level signal is stored, so that the storage function of the first storage sub-module 121 and the second storage sub-module 122 is realized, and the storage function adopts a dynamic storage mode. The shift register circuit has advantages of low power consumption and low cost by adopting the dynamic storage mode to store the input signal.

Figure 9:
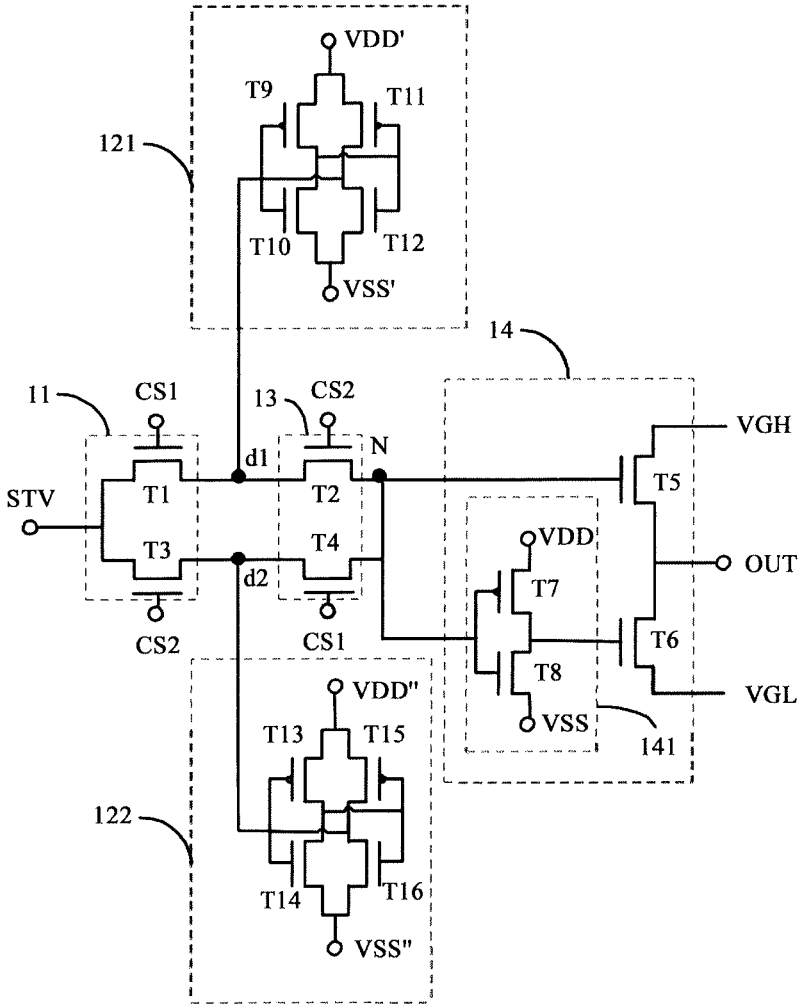
FIG. 9 is a diagram illustrating a shift register circuit according to an embodiment of the present disclosure.

In some implementations, as shown in FIG. 9, the first storage sub-module 121 may include a ninth thin film transistor T9, a tenth thin film transistor T10, an eleventh thin film transistor T11 and a twelfth thin film transistor T12, a first electrode of the ninth thin film transistor T9 and a first electrode of the eleventh thin film transistor T11 are both coupled to a second high voltage terminal VDD', a second electrode of the ninth thin film transistor T9 is coupled to a first electrode of the tenth thin film transistor T10, a gate electrode of the eleventh thin film transistor T11 and a gate electrode of the twelfth thin film transistor T12, respectively, a gate electrode of the ninth thin film transistor T9 and a gate electrode of the tenth thin film transistor T10 are both coupled to the first node d1, a second electrode of the tenth thin film transistor T10 and a second electrode of the twelfth thin film transistor T12 are both coupled to a second low voltage terminal VSS', and a second electrode of the eleventh thin film transistor T11 is coupled to the first node d1 and a first electrode of the twelfth thin film transistor T12, respectively; the second storage sub-module 122 may include a thirteenth thin film transistor T13 and a fourteenth thin film transistor T14, a fifteenth thin film transistor T15 and a sixteenth thin film transistor T16, a first electrode of the thirteenth thin film transistor T13 and a first electrode of the fifteenth thin film transistor T15 are coupled to a third high voltage terminal VDD", a second electrode of the thirteenth thin film transistor T13 is coupled to a first electrode of the fourteenth thin film transistor T14, a gate electrode of the fifteenth thin film transistor T15 and a gate electrode of the sixteenth thin film transistor T16, respectively, a gate electrode of the thirteenth thin film transistor and a gate electrode of the fourteenth thin film transistor T14 are coupled to the second node d2, a second electrode of the fourteenth thin film transistor T14 and a second electrode of the sixteenth thin film transistor T16 are coupled to a third low voltage terminal VSS", and a second electrode of the fifteenth thin film transistor T15 is coupled to the second node d2 and a first electrode of the sixteenth thin film transistor T16, respectively.

Referring to FIG. 9, the ninth thin film transistor T9, the eleventh thin film transistor T11, the thirteenth thin film transistor T13, and the fifteenth thin film transistor T15 may be all P-type thin film transistors, and the tenth thin film transistor T10, the twelfth thin film transistor T12, the fourteenth thin film transistor T14, and the sixteenth thin film transistor T16 may be all N-type thin film transistors.

As described above, the first storage sub-module 121 and the second storage sub-module 122 may employ a dynamic storage mode, but may alternatively employ a static storage mode. Specifically, referring to FIG. 9, taking the second storage sub-module 122 as an example, when the third thin film transistor T3 is turned on under the control of the second control signal, that is, when the second control signal is a high level signal, if the input signal is a high level signal, the fourteenth thin film transistor T14 is turned on, the sixteenth thin film transistor T16 is turned off, and then a high level logic "1" is written; if the input signal is a low level signal, the potential of the second node d2 is low, so that the thirteenth thin film transistor T13 is turned on, the fifteenth thin film transistor T15 is turned off, and a low level logic "0" is written.

To sum up, the shift register circuit of the embodiment of the present disclosure can generate the pulse with any integer multiple of unit pulse widths, and then control the light emitting duration by transferring the pulse with any integer multiple of unit pulse widths, thereby improving the flexibility of controlling the light emitting duration; the input signal may be stored in a dynamic storage mode or a static storage mode, and the reliability is high.

Figure 10:
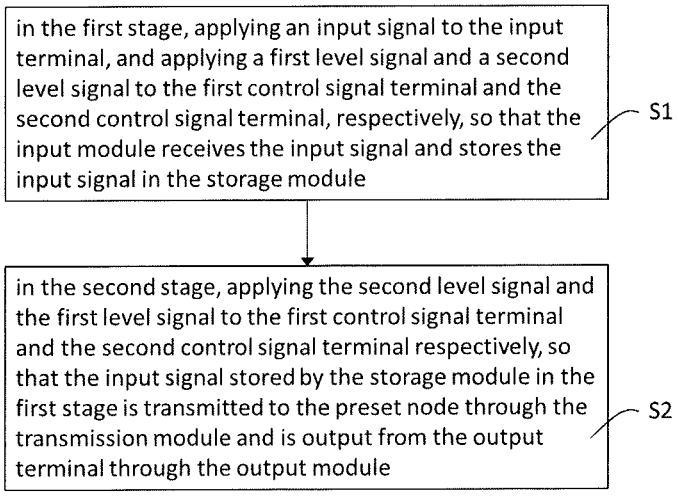
FIG. 10 is a flowchart of a method for driving a shift register circuit according to an embodiment of the present disclosure.

FIG. 10 is a flowchart of a method for driving a shift register circuit according to an embodiment of the present disclosure.

The method for driving the shift register circuit in the embodiment is used to drive the shift register circuit of the embodiment of the present disclosure.

As shown in FIG. 10, the method for driving the shift register circuit includes following steps S1 and S2.

S1, in the first stage, applying the input signal to the input terminal, and applying the first level signal and the second level signal to the first control signal terminal and the second control signal terminal, respectively, so that the input module receives the input signal and stores the input signal in the storage module.

The first level signal is a high level signal and the second level signal is a low level signal, or the first level signal is a low level signal and the second level signal is a high level signal.

S2, in the second stage, applying the second level signal and the first level signal to the first control signal terminal and the second control signal terminal respectively, so that the input signal stored by the storage module in the first stage is transmitted to the preset node through the transmission module and is output from the output terminal through the output module.

Specifically, for example, in the first stage, the input signal (e.g., high level signal) may be applied to the input terminal, and a low level signal and a high level signal may be applied to the first control signal terminal and the second control signal terminal, respectively, so that the input module receives the high level signal and stores it in the storage module; in the second stage, a high level signal and a low level signal may be applied to the first control signal terminal and the second control signal terminal, respectively, to output the high level signal through the output terminal OUT. The pulse width of each of the high level signal and the low level signal is 1H, and may be referred to as a unit pulse width. The first stage and the second stage are cyclically performed, the pulse with any integral multiple of unit pulse widths can be generated at the output terminal, therefore, the range of the pulse width is adjustable, and in the self-luminous display circuit, the range of the pulse width output by the output terminal of the shift register circuit is the adjustable range of the light emitting duration, therefore, by controlling the light emitting duration through the shift register circuit in the embodiment, the light emitting duration can be more flexibly controlled.

It should be noted that, for the specific implementation of the method for driving the shift register circuit in the embodiment of the present disclosure, reference may be made to the specific implementation of the shift register circuit in the embodiment of the present disclosure, and details are not described here again.

The method for driving the shift register circuit in the embodiment of the present disclosure can generate the pulse with any integral multiple of unit pulse widths, and then the light emitting duration is controlled by transferring the pulse with any integral multiple of unit pulse widths, thereby the flexibility of controlling the light emitting duration is improved.

Figure 11:
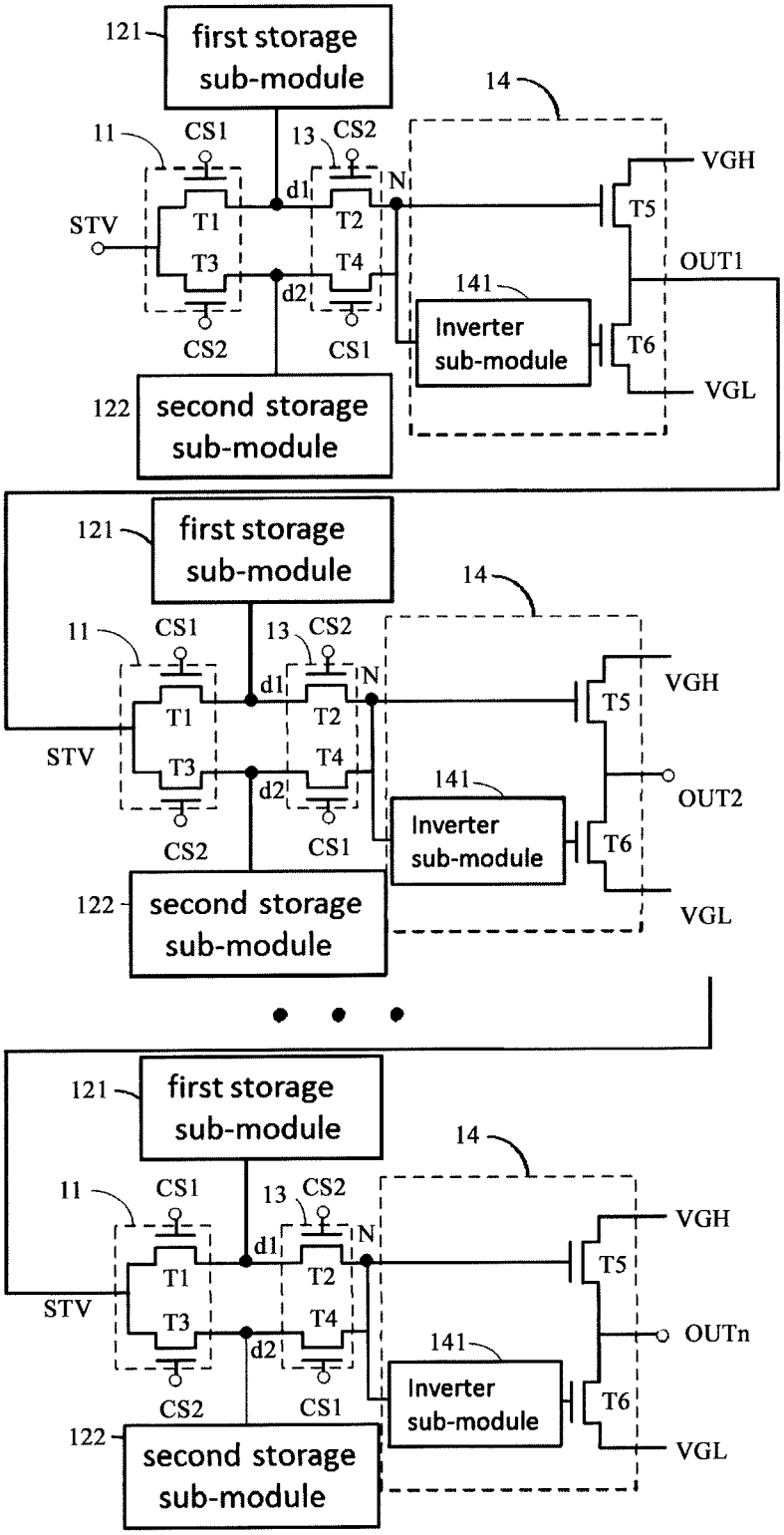
FIG. 11 is a schematic structural diagram of a gate driving circuit according to an embodiment of the present disclosure.

FIG. 11 is a schematic structural diagram of a gate driving circuit according to an embodiment of the present disclosure.

As shown in FIG. 11, the gate driving circuit 100 includes a plurality of stages of shift register units, each stage of shift register unit includes the shift register circuit 10 according to the embodiment of the present disclosure, and an output terminal of the shift register circuit in the current stage of shift register unit is an input terminal of the shift register circuit in the next stage of shift register unit.

In practical applications, the gate driving circuit 100 drives the pixel circuits, and the gate driving circuit 100 includes a plurality of cascaded shift register circuits 10, where each shift register circuit 10 can drive one row of pixel circuits, and then the plurality of shift register circuits 10 drive the pixel circuits row by row to display images.

The gate driving circuit of the embodiment of the present disclosure can generate the pulse with any integral multiple of unit pulse widths, and then control the light emitting duration by transferring the pulse with any integral multiple of unit pulse widths, thereby improving the flexibility of controlling the light emitting duration.

Figure 12:
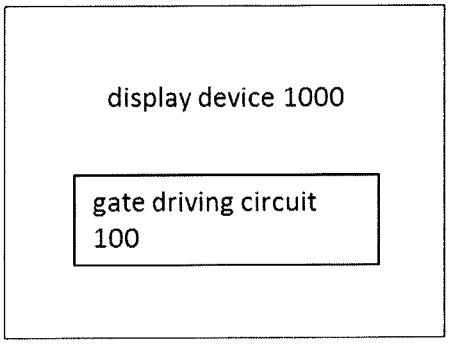
FIG. 12 is a structural diagram of a display device according to an embodiment of the present disclosure.

Further, an embodiment of the present disclosure provides a display device. FIG. 12 is a structural diagram of a display device according to an embodiment of the present disclosure.

As shown in FIG. 12, the display device 1000 includes the gate driving circuit 100 according to the embodiment of the present disclosure.

In practical applications, when the display device 1000 displays an image, the gate driving circuit 100 drives the pixel circuits, and the gate driving circuit 100 includes a plurality of cascaded shift register circuits 10, where each shift register circuit 10 can drive one row of pixel circuits, and then the plurality of shift register circuits 10 realize driving the pixel circuits of the display device 1000 row by row to display the image.

The display device can generate the pulse with any integral multiple of unit pulse widths, and then the light emitting duration is controlled by transferring the pulse with any integral multiple of unit pulse widths, so that the flexibility of controlling the time length is improved.

It should be understood that features of the embodiments of the present disclosure may be combined arbitrarily without contradiction.

Furthermore, the terms "first", "second" and the like are used for descriptive purposes only and are not to be construed as indicating or implying a relative importance or order or to implicitly indicate a number of the technical features defined. A feature defined by "first", "second", etc. may be explicitly or implicitly stated as including at least one of the feature. In the description of the present disclosure, "plurality" means at least two, e.g., may be two, three, etc., unless explicitly specifically limited otherwise.

In the present disclosure, unless expressly stated or limited otherwise, the terms "coupled" and the like are to be construed broadly and include, for example, fixedly coupled, releasably coupled, or combinations thereof; may be mechanically or electrically coupled; may be directly coupled or indirectly coupled through intervening media, or may be inter-coupled toin two elements or in a relationship where two elements interact with each other, unless otherwise specifically limited. The specific meaning of the above terms in the present disclosure may be understood as a specific case by a person of ordinary, skill in the art.

While embodiments of the present disclosure have been shown and described above, it should be understood that the above embodiments are exemplary and not to be construed as limiting the present disclosure, and that changes, modifications, substitutions and alterations may be made to the above embodiments by those of ordinary skill in the art within the scope of the present disclosure.

The invention claimed is:

1. A shift register circuit, comprising an input terminal, a first control signal terminal, a second control signal terminal and an output terminal, and further comprising:

an input module coupled to the input terminal, the first control signal terminal and the second control signal terminal, and configured to receive an input signal input by the input terminal under a control of a first control signal input by the first control signal terminal and a second control signal input by the second control signal terminal;

a storage module coupled to the input module and configured to store the input signal received by the input module;

a transmission module coupled to the storage module, the first control signal terminal and the second control signal terminal and configured to transmit the input signal stored by the storage module to a preset node under the control of the first control signal and the second control signal; and an output module coupled to the preset node, the output terminal, a high level bias voltage line and a low level bias voltage line and configured to output a high level signal or a low level signal through the output terminal under a control of the input signal at the preset node, wherein the storage module comprises a first storage sub-module and a second storage sub-module, and the input module comprises:

a first thin film transistor, which comprises a first electrode coupled to the input terminal, a second electrode coupled to the first storage sub-module to form a first node, and a gate electrode coupled to the first control signal terminal; and a third thin film transistor, which comprises a first electrode coupled to the input terminal, a second electrode coupled to the second storage sub-module to form a second node, and a gate electrode coupled to the second control signal terminal, wherein the transmission module comprises:

a second thin film transistor, which comprises a first electrode coupled to the first node, a second electrode coupled to the preset node, and a gate electrode coupled to the second control signal terminal;

and a fourth thin film transistor, which comprises a first electrode coupled to the second node, a second electrode coupled to the preset node, and a gate electrode coupled to the first control signal terminal, and wherein the first thin film transistor, the second thin film transistor, the third thin film transistor and the fourth thin film transistor are thin film transistors of a same type, only one of the first thin film transistor and the third thin film transistor is turned on at a same time, only one of the second thin film transistor and the fourth thin film transistor is turned on at a same time, and the first control signal and the second control signal are complementary.

2. The shift register circuit of claim 1, wherein the output module comprises:

an inverter sub-module coupled to the preset node and configured to output a signal which is inverted to the input signal at the preset node;

a fifth thin film transistor, which comprises a first electrode coupled to the high level bias voltage line, a second electrode coupled to the output terminal, and a gate electrode coupled to the preset node; and a sixth thin film transistor, which comprises a first electrode coupled to the output terminal, a second electrode coupled to the low level bias voltage line, and a gate electrode coupled to the preset node through the inverter sub-module.

3. The shift register circuit of claim 2, wherein the fifth thin film transistor and the sixth thin film transistor are both N-type thin film transistors.

4. The shift register circuit of claim 2, wherein the inverter sub-module comprises:

a seventh thin film transistor, which comprises a first electrode coupled to a first high level terminal, a second electrode coupled to the gate electrode of the sixth thin film transistor, and a gate electrode coupled to the preset node; and an eighth thin film transistor, which comprises a first electrode coupled to the gate electrode of the sixth thin film transistor, a second electrode coupled to a first low level terminal, and a gate electrode coupled to the preset node.

5. The shift register circuit of claim 4, wherein the seventh thin film transistor is a P-type thin film transistor, and the eighth thin film transistor is an N-type thin film transistor.

6. The shift register circuit of claim 1, wherein the first storage sub-module comprises a first capacitor, which comprises one terminal coupled to the first node, and another terminal coupled to a first common terminal; and the second storage sub-module comprises a second capacitor, which comprises one terminal coupled to the second node, and another terminal coupled to a second common terminal.

7. The shift register circuit of claim 1, wherein the first storage sub-module comprises a ninth thin film transistor, a tenth thin film transistor, an eleventh thin film transistor, and a twelfth thin film transistor, a first electrode of the ninth thin film transistor and a first electrode of the eleventh thin film transistor are both coupled to a second high voltage terminal, a second electrode of the ninth thin film transistor is coupled to a first electrode of the tenth thin film transistor, a gate electrode of the eleventh thin film transistor and a gate electrode of the twelfth thin film transistor, a gate electrode of the ninth thin film transistor and a gate electrode of the tenth thin film transistor are both coupled to the first node, a second electrode of the tenth thin film transistor and a second electrode of the twelfth thin film transistor are both coupled to a second low voltage terminal, a second electrode of the eleventh thin film transistor is coupled to the first node and a first electrode of the twelfth thin film transistor; and the second storage sub-module comprises a thirteenth thin film transistor, a fourteenth thin film transistor, a fifteenth thin film transistor, and a sixteenth thin film transistor, a first electrode of the thirteenth thin film transistor and a first electrode of the fifteenth thin film transistor are both coupled to a third high voltage terminal, a second electrode of the thirteenth thin film transistor is coupled to a first electrode of the fourteenth thin film transistor, a gate electrode of the fifteenth thin film transistor and a gate electrode of the sixteenth thin film transistor, a gate electrode of the thirteenth thin film transistor and a gate electrode of the fourteenth thin film transistor are both coupled to the first node, a second electrode of the fourteenth thin film transistor and a second electrode of the sixteenth thin film transistor are both coupled to a third low voltage terminal, a second electrode of the fifteenth thin film transistor is coupled to the second node and a first electrode of the sixteenth thin film transistor.

8. The shift register circuit of claim 7, wherein the ninth thin film transistor, the eleventh thin film transistor, the thirteenth thin film transistor and the fifteenth thin film transistor are all P-type thin film transistors, and the tenth thin film transistor, the twelfth thin film transistor, the fourteenth thin film transistor and the sixteenth thin film transistor are all N-type thin film transistors.

9. A method for driving the shift register circuit according to claim 1, the method comprising:

in a first stage, applying the input signal to the input terminal, and applying a first level signal and a second level signal to the first control signal terminal and the second control signal terminal respectively, so that the input module receives the input signal and stores the input signal in the storage module; and in a second stage, applying the second level signal and the first level signal to the first control signal terminal and the second control signal terminal respectively, so that the input signal stored by the storage module in the first stage is transmitted to the preset node through the transmission module and is output from the output terminal through the output module.

10. A gate driving circuit, comprising a plurality of stages of shift register units, each stage of the shift register unit comprising the shift register circuit according to claim 1, wherein the output terminal of the shift register circuit in a stage of the shift register unit is the input terminal of the shift register circuit in a next stage of the shift register unit.

11. A display device, comprising the gate driving circuit according to claim 10.

* * * * *